United States Patent [19]

Hart

[11] 4,424,063

[45] Jan. 3, 1984

[54] HIGH FLASH POINT ADDITIVES OR COMPOSITIONS FOR GASOLINE AND DIESEL FUELS

[75] Inventor: Rien 'T Hart, Rotterdam-Botlek, Netherlands

[73] Assignee: XRG International, Inc., Stuart, Fla.

[21] Appl. No.: 304,989

[22] PCT Filed: Nov. 17, 1980

[86] PCT No.: PCT/US80/01530

§ 371 Date: Mar. 10, 1981

§ 102(e) Date: Mar. 10, 1981

[87] PCT Pub. No.: WO82/01718

PCT Pub. Date: May 27, 1982

[51] Int. Cl.[3] ..... C10L 1/22

[52] U.S. Cl. ..... 44/56; 44/53; 44/57; 44/67; 44/68; 44/72; 44/77

[58] Field of Search ..... 44/53, 56, 57, 67, 68, 44/72, 74, 77

[56] References Cited

U.S. PATENT DOCUMENTS

| | | | |
|---|---|---|---|
| 1,271,114 | 7/1918 | Backhaus | 44/56 |
| 1,622,572 | 3/1927 | Chandler | 44/56 |
| 4,073,626 | 2/1978 | Simmons | 44/57 |
| 4,099,930 | 7/1978 | Webb | 44/57 |
| 4,129,421 | 12/1978 | Webb | 44/57 |
| 4,145,190 | 3/1979 | Webb | 44/56 |
| 4,265,639 | 5/1981 | Sholtz | 44/57 |

*Primary Examiner*—John Doll
*Assistant Examiner*—Y. Harris-Smith
*Attorney, Agent, or Firm*—John S. Roberts, Jr.

[57] ABSTRACT

An improved energy-saving fuel additive for diesel engines and gasoline engines which comprises separate compositions which raise the flash point from about 6° to 29° C. In the case of the diesel additive, the following formulation is preferred:

Elemental iron: 0.01%
Methyl isobutyl ketone: 5.0%
Picric acid: 1.5%
Normal butyl alcohol: 20.0%
Kerosene: 73.0%
Nitrobenzene: 0.08%
Primene 81R: 0.05%

The composition of the agent for gasoline to high flash point is somewhat different and may be noted as follows:

Copper carbonate hydroxide: 0.02%
Methyl isobutyl ketone: 5.0%
Normal butyl alcohol: 20.0%
Kerosene: 73.0%
Picric acid: 1.5%
Nitrobenzene: 0.08%
Primene 81R: 0.05%

6 Claims, No Drawings

HIGH FLASH POINT ADDITIVES OR COMPOSITIONS FOR GASOLINE AND DIESEL FUELS

This invention relates to two compositions which are useful in increasing the flash point of (a) diesel fuels and (b) gasoline. In each case application of a dosage amount of the additive increases the flash point of the resulting composition from about 6° C. to 29° C. This, in effect, relieves the user of strict legal burdens and enables the use of the compositions in local and interstate traffic. A dosage of the additive to fuels is in the range 1:1000 to 1:2000 with a preferred dosage of about 1:1600 parts by volume.

The flash point of a fuel indicates the temperature below which it can be handled without danger of fire. This is the temperature to which the fuel must be heated to create sufficient fuel vapors above the surface of the liquid fuel for ignition to occur in the presence of an open flame.

Prior Art Statement

Of interest relative to patent prior art are three patents of Dr. Harry M. Webb, assigned to XRG International, Inc. This group of patents; namely, U.S. Pat. Nos. 4,099,930, 4,129,421 and 4,145,190, utilizes ferrous sulfate in conjunction with picric acid and includes water in the solvent milieu. The present additives are based upon copper(II) carbonate hydroxide and elemental iron together with picric acid. Additionally, U.S. Pat. No. 1,669,181 teaches copper and iron salts in an internal combustion engine fuel. Related to this application is an earlier application filed under the Patent Cooperation Treaty, U.S. Ser. No. 80/01509 filed Nov. 12, 1980.

In the case of high flash point composition designed for diesel fuels, a range and preferred composition is set out below:

| | Range | Preferred |
|---|---|---|
| Elemental iron | .01-.03% | .01% |
| Methyl isobutyl ketone | 3-7% | 5.0% |
| Picric acid | 1-2% | 1.5% |
| Normal butyl alcohol | 20-30% | 20.0% |
| Kerosene | 75-59% | 73.0% |
| Nitrobenzene | .05-.11% | .08% |
| Primene 81R | .1-.2% | .05% |

It is noted of interest in the diesel formulation that the most important elements are elemental iron and picric acid.

The composition for the agent for gasoline to high flash point is set out below:

| | Range | Preferred |
|---|---|---|
| Copper carbonate hydroxide | .01-.03% | .02% |
| Methyl isobutyl ketone | 3-7% | 5.0% |
| Normal butyl alcohol | 20-30% | 20.0% |
| Kerosene | 75-59% | 73.0% |
| Picric acid | 1-2% | 1.5% |
| Nitrobenzene | .05-.11% | .08% |
| Primene 81R | .1-.2% | .05% |

It is noted that in this high flash point gasoline composition the most important constituents are copper carbonate hydroxide and picric acid. For solubility purposes, in addition to the above components, copper acetate may be used in amounts of 0.01-0.05%.

The Ingredients

Picric Acid

This trinitrophenol acts synergistically with the elemental iron or copper carbonate hydroxide to give the active component of this invention.

Kerosene

This is a blend of aliphatic hydrocarbons with a boiling point of 19°-59° C. (150°-280° F.).

The Alcoholic Solvents

Normal butyl alcohol is used here in the formulation designed to give a high flash point.

Nitrobenzene

This compound is utilized as an additional solvent. It is miscible with alkanols and is a superior organic solvent for the picric acid.

Primene

Primenes are tertiary alkylamines which are a cross of primary aliphatic amines of the general formula $R_1(R_2)(R_3)CNH_2$ in which the amino group is linked to a tertiary carbon atom. The amines utilized in this invention are Primene 81R and Primene JM-T with the 81R preferred. These amines are anti-oxidants and stabilizers for fuel oils and jet fuels.

Copper Acetate

This ingredient is known as copper(II) acetate and is useful as a catalyst in polymerization processes.

Copper Carbonate Hydroxide

This is also known as green basic copper carbonate which occurs in nature as the mineral malachite.

Ketones

Methyl isobutyl ketone is used and is a lower ketone useful as a solvent.

Iron

Preferably iron powder is used for the high flash point diesel invention.

EXAMPLE 1

Preparation of High Flash Point Diesel Composition

Methyl isobutyl ketone: 4.0%
Picric acid: 1.5%
N-butyl alcohol: 20.0%
Iron (element powder): 0.01%
Kerosene: 73.36%
Nitrobenzene: 0.08%
Primene 81R: 0.05%

Dissolve the picric acid in the methyl isobutyl ketone; add the N-butyl alcohol and elemental iron. The reaction time during stirring is 24 hours. Add the kerosene, nitrobenzene, and Primene.

EXAMPLE 2

Preparation of High Flash Point Gasoline Additive

Methyl isobutyl ketone: 5.0%
N-butyl alcohol: 20.0%
Copper carbonate: 0.02%
Picric acid: 1.54%
Kerosene: 73.0%
Primene 81R: 0.05%
Nitrobenzene: 0.08%

The components are mixed in a manner similar to Example 1 above.

EXAMPLE 3

Using the same preparation as in Example 2, about 0.01–0.05% of copper acetate was added.

I claim:

1. A high flash point agent for gasoline comprising elemental iron, methyl isobutyl ketone, picric acid, normal butyl alcohol, kerosene, nitrobenzene, and a Primene which is a tertiary alkyl amine which is a cross of primary aliphatic amines of the general formula $R_1(R_2)(R_3)CNH_2$ in which the amino group is linked to a tertiary carbon atom.

2. A diesel additive for increasing flash point includes the following:

| | |
|---|---|
| Elemental iron | .01–.03% |
| Methyl isobutyl ketone | 3–7% |
| Picric acid | 1–2% |
| Normal butyl alcohol | 20–30% |
| Kerosene | 75–59% |
| Nitrobenzene | .05–.11% |
| Primene 81R, a tertiary [Tertiary] alkyl amine which is a cross of primary aliphatic amines of the general formula $R_1(R_2)(R_3)CNH_2$ in which the amino group is linked to a tertiary carbon atom | .1–.2% |

3. The additive according to claim 2 wherein the composition utilized is as follows:

| | |
|---|---|
| Elemental iron | .01% |
| Methyl isobutyl ketone | 5.0% |
| Picric acid | 1.5% |
| Normal butyl alcohol | 20.0% |
| Kerosene | 73.0% |
| Nitrobenzene | .08% |
| Primene 81R, a tertiary [Tertiary] alkyl amine which is a cross of primary aliphatic amines of the general formula $R_1(R_2)(R_3)CNH_2$ in which the amino group is linked to a tertiary carbon atom | .05% |

4. An additive for a high flash point gasoline comprising:

| | |
|---|---|
| Copper carbonate hydroxide | .01–.03% |
| Methyl isobutyl ketone | 3–7% |
| Normal butyl alcohol | 20–30% |
| Kerosene | 75–59% |
| Picric acid | 1–2% |
| Nitrobenzene | .05–.11% |
| Primene 81R, a tertiary [Tertiary] alkyl amine which is a cross of primary aliphatic amines of the general formula $R_1(R_2)(R_3)CNH_2$ in which the amino group is linked to a tertiary carbon atom | .1–.2% |

5. The additive according to claim 4 wherein the composition utilized is as follows:

| | |
|---|---|
| Copper carbonate hydroxide | .02% |
| Methyl isobutyl ketone | 5.0% |
| Normal butyl alcohol | 20.0% |
| Kerosene | 73.0% |
| Picric acid | 1.5% |
| Nitrobenzene | .08% |
| Primene 81R, a tertiary [Tertiary] alkyl amine which is a cross of primary aliphatic amines of the general formula $R_1(R_2)(R_3)CNH_2$ in which the amino group is linked to a tertiary carbon atom | .05% |

6. The additive according to claim 4 wherein for solubility purposes there is added an amount of 0.1–0.5% of copper acetate.

* * * * *